US011634800B2

(12) United States Patent
Lee et al.

(10) Patent No.: US 11,634,800 B2
(45) **Date of Patent: *Apr. 25, 2023**

(54) HIGH-STRENGTH AUSTENITE-BASED HIGH-MANGANESE STEEL MATERIAL AND MANUFACTURING METHOD FOR SAME

(71) Applicant: POSCO, Pohang-si (KR)

(72) Inventors: Un-Hae Lee, Gwangyang-si (KR); Tae-Kyo Han, Gwangyang-si (KR); Sang-Deok Kang, Gwangyang-si (KR); Sung-Kyu Kim, Gwangyang-si (KR); Yong-Jin Kim, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 11 days.

This patent is subject to a terminal disclaimer.

(21) Appl. No.: 16/957,451

(22) PCT Filed: Dec. 20, 2018

(86) PCT No.: PCT/KR2018/016387

§ 371 (c)(1),
(2) Date: Jun. 24, 2020

(87) PCT Pub. No.: WO2019/125025

PCT Pub. Date: Jun. 27, 2019

(65) Prior Publication Data

US 2020/0347486 A1 Nov. 5, 2020

(30) Foreign Application Priority Data

Dec. 24, 2017 (KR) ..... 10-2017-0178943

(51) Int. Cl.
*C22C 38/04* (2006.01)
*C21D 8/02* (2006.01)
(Continued)

(52) U.S. Cl.
CPC ..... *C22C 38/04* (2013.01); *C21D 8/0205* (2013.01); *C21D 8/0226* (2013.01);
(Continued)

(58) Field of Classification Search
CPC .... C21D 2211/001; C21D 6/00; C21D 6/005; C21D 8/0205; C21D 8/0226; C21D 8/0231; C22C 38/00; C22C 38/04; C22C 38/38
(Continued)

(56) References Cited

U.S. PATENT DOCUMENTS 10,961,610 B2 * 3/2021 Lee ..... C22C 38/18
2002/0121318 A1 * 9/2002 Morito ..... C22C 38/58 148/620
(Continued)

FOREIGN PATENT DOCUMENTS

CN 1451777 A 10/2003
CN 105177262 A 12/2015
(Continued)

OTHER PUBLICATIONS

International Search Report and Written Opinion issued in International Application No. PCT/KR2018/016387 dated Mar. 28, 2019, with English translation.
(Continued)

*Primary Examiner* — Jie Yang
(74) *Attorney, Agent, or Firm* — Morgan, Lewis & Bockius LLP

(57) ABSTRACT

A high-strength austenite-based high-manganese steel material and a manufacturing method for the same, the steel material comprising: manganese (Mn): 20 to 23 wt %, carbon (C): 0.3 to 0.5 wt %, silicon (Si): 0.05 to 0.50 wt %, phosphorus (P): 0.03 wt % or less, sulfur (S): 0.005 wt % or less, aluminum (Al): 0.050 wt % or less, chromium (Cr): 2.5
(Continued)

wt % or less, boron (B): 0.0005 to 0.01 wt %, nitrogen (N): 0.03 wt % or less, and a balance of iron (Fe) and other inevitable impurities, wherein stacked defect energy (SFE) represented by the following relationship 1 is 3.05 mJ/m$^2$ or more, and a microstructure comprises 95 area % or more (including 100 area %) of austenite, and comprises 6 area % or more of strain grain boundaries in an austenite recrystallized grain, is provided.

$$SFE(mJ/m^2)=-24.2+0.950*Mn+39.0*C-2.53*Si-5.50*Al-0.765*Cr \quad \text{[Relationship 1]}$$

where Mn, C, Cr, Si, and Al denote weight percent of respective components.

4 Claims, 2 Drawing Sheets

(51) Int. Cl.

| | |
|---|---|
| ***C22C 38/00*** | (2006.01) |
| ***C22C 38/02*** | (2006.01) |
| ***C22C 38/06*** | (2006.01) |
| ***C22C 38/32*** | (2006.01) |
| *C21D 6/00* | (2006.01) |

(52) U.S. Cl.
CPC ..... *C22C 38/001* (2013.01); *C22C 38/002* (2013.01); *C22C 38/02* (2013.01); *C22C 38/06* (2013.01); *C22C 38/32* (2013.01); *C21D 6/005* (2013.01); *C21D 2211/001* (2013.01); *C21D 2211/008* (2013.01)

(58) Field of Classification Search
USPC ..... 148/337
See application file for complete search history.

(56) References Cited

U.S. PATENT DOCUMENTS

| | | | | |
|---|---|---|---|---|
| 2006/0278309 | A1 | 12/2006 | Bouzekri et al. | |
| 2008/0035248 | A1* | 2/2008 | Cugy | C21D 8/0205 148/621 |
| 2009/0074605 | A1 | 3/2009 | Kim et al. | |
| 2009/0308499 | A1 | 12/2009 | Scott et al. | |
| 2013/0209833 | A1 | 8/2013 | Scott et al. | |
| 2017/0298467 | A1 | 10/2017 | Suehiro et al. | |
| 2018/0363108 | A1 | 12/2018 | Lee et al. | |
| 2019/0078174 | A1 | 3/2019 | Lee et al. | |
| 2021/0189533 | A1* | 6/2021 | Lee | C21D 8/0226 |

FOREIGN PATENT DOCUMENTS

| | | | |
|---|---|---|---|
| CN | 107109552 | A | 8/2017 |
| JP | H02-190445 | A | 7/1990 |
| JP | 2002-66603 | A | 3/2002 |
| JP | 2005-120399 | A | 5/2005 |
| JP | 2006-528278 | A | 12/2006 |
| JP | 2009-545676 | A | 12/2009 |
| JP | 2013-023743 | A | 2/2013 |
| JP | 2016-196703 | A | 11/2016 |
| KR | 10-2009-0043508 | A | 5/2009 |
| KR | 10-2014-0134846 | A | 11/2014 |
| KR | 10-2016-0077558 | A | 7/2016 |
| KR | 10-2016-0077594 | A | 7/2016 |
| KR | 10-2016-0078840 | A | 7/2016 |
| KR | 10-1726081 | B1 | 4/2017 |
| KR | 10-2017-0075657 | A | 7/2017 |
| WO | 2017/055107 | A1 | 4/2017 |
| WO | 2017/111510 | A1 | 6/2017 |
| WO | 2017/148892 | A1 | 9/2017 |

OTHER PUBLICATIONS

Chinese Office Action dated Mar. 25, 2021 issued in Chinese Patent Application No. 201880083710.1 (with English translation).
Production Group of Revolutionary Committee of Shanxi Taiyuan Iron and Steel Co., "Silicon Steel Sheet Reference Material 9," 1973, pp. 1-213 (with English translation).
Extended European Search Report dated Jan. 29, 2021 issued in European Patent Application No. 18891203.4.
Japanese Office Action dated Oct. 5, 2021, issued in corresponding Japanese Patent Application No. 2020-554999.

* cited by examiner

【FIG. 1】
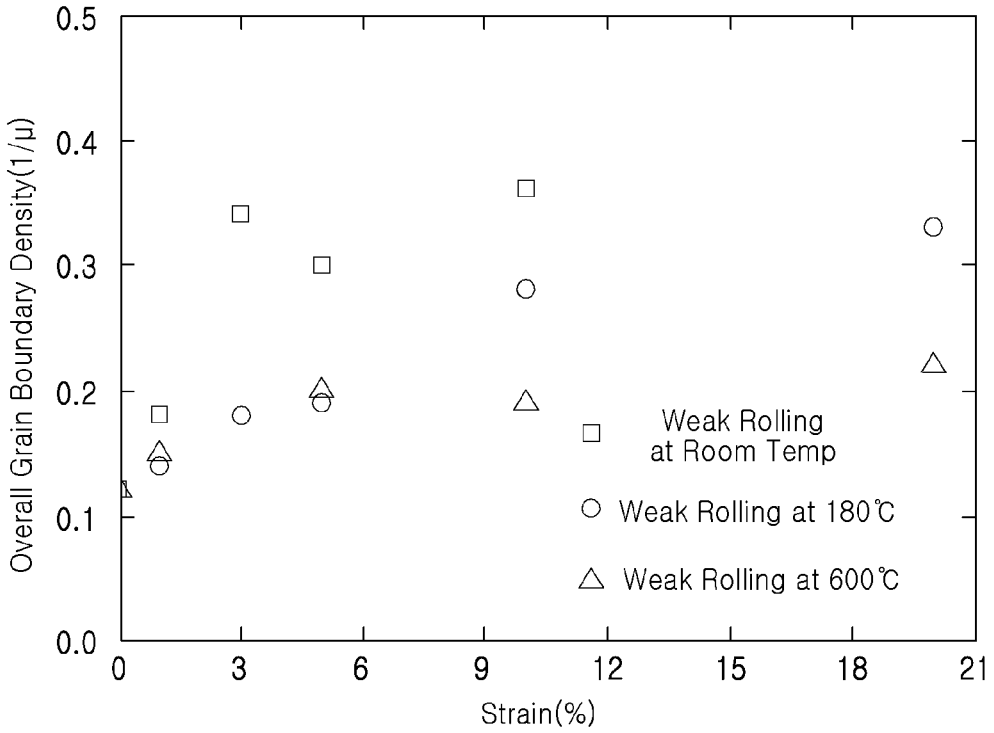

【FIG. 2】
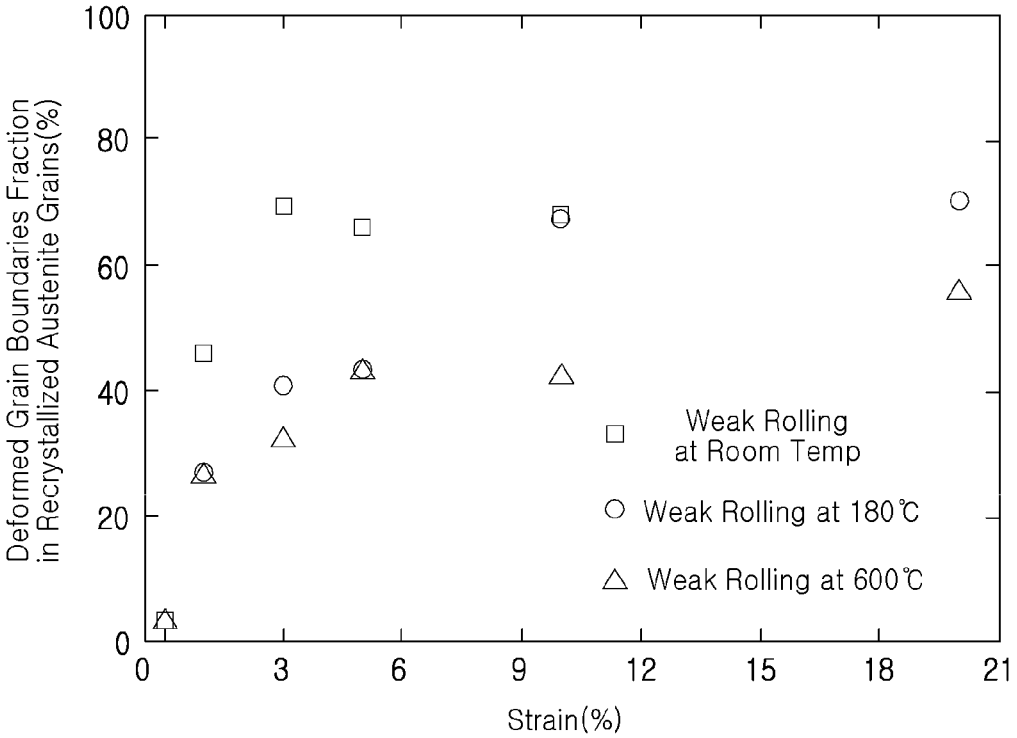
【FIG. 3】
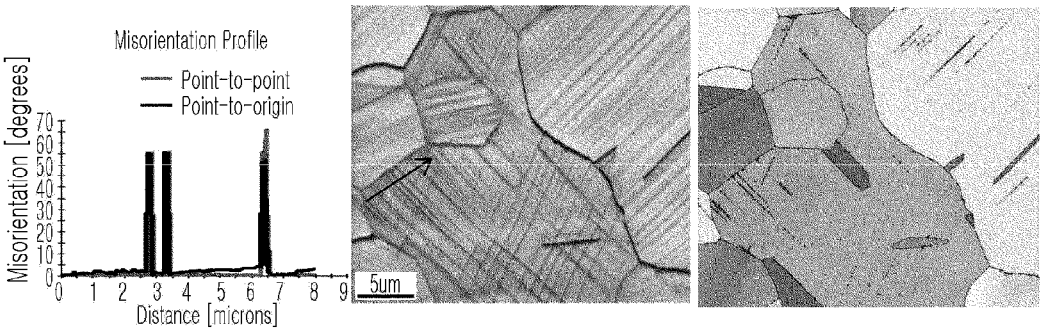

HIGH-STRENGTH AUSTENITE-BASED HIGH-MANGANESE STEEL MATERIAL AND MANUFACTURING METHOD FOR SAME

CROSS REFERENCE

This application is the U.S. National Phase under 35 U.S.C. § 371 of International Application No. PCT/KR2018/016387 filed on Dec. 20, 2018, which claims the benefit of Korean Application No. 10-2017-0178943 filed on Dec. 24, 2017, the entire contents of each are hereby incorporated by reference.

TECHNICAL FIELD

The present disclosure relates to an austenite-based high-manganese (Mn) steel material and a method of manufacturing the same, and more particularly, to an austenite-based high-manganese steel material having excellent strength and ductility, and a method of manufacturing the same.

BACKGROUND ART

Austenite-based high-manganese (Mn) steel is characterized by having relatively high toughness, as an austenite phase is stable even at room temperature or cryogenic temperature by adjusting the content of manganese and carbon, which may be elements that enhance stability of the austenite phase. Properties of the austenite phase may be used for various purposes such as those in electric transformer structures or the like that require relatively high non-magnetic properties.

Recently, as a non-magnetic steel material, such as those described above, a steel material having excellent non-magnetic properties, stabilized austenite by adding a relatively large amount of manganese (Mn) and carbon (C), has been developed.

The austenite phase may be a paramagnetic material, and may have relatively low permeability and excellent non-magnetic properties, compared to ferrite.

However, high-manganese (Mn) steel having austenite as a main structure may have an advantage of excellent low-temperature toughness due to properties of ductile fracture even at low temperatures, but may have relatively low strength, especially relatively low yield strength due to its unique crystal structure, face-centered cubic structure. Accordingly, there is a limitation to reductions in costs by lowering a designed thickness of the steel sheet.

In order to increase strength, there are solid solution strengthening by adding alloying elements, precipitation hardening by adding precipitate forming elements, pancaking rolling by controlling a finish rolling temperature, or the like. However, there are various problems such as an increase in economic costs due to the addition of alloying elements, a limitation in formation of precipitates due to a limit of the solid solution in austenite of precipitates, and the like, and a decrease in impact toughness due to an increase in strength during rolling of pancaking by control of the finish rolling temperature, and the like. Accordingly, there is a keen need to develop an austenitic steel material having high strength while maintaining elongation by an economical and effective method.

PRIOR TECHNICAL LITERATURE (Patent Document 1) Korea Patent Publication No. 10-2009-0043508

DISCLOSURE

Technical Problem

An aspect of the present disclosure is to provide an austenite-based high-manganese steel material having excellent strength and ductility.

Another aspect of the present disclosure is to provide a method of manufacturing an austenite-based high-manganese steel material having excellent strength and ductility.

Technical Solution

According to an aspect of the present disclosure, a high-strength austenite-based high-manganese steel material, includes: manganese (Mn): 20 to 23 wt %, carbon (C): 0.3 to 0.5 wt %, silicon (Si): 0.05 to 0.50 wt %, phosphorus (P): 0.03 wt % or less (excluding 0 wt %), sulfur (S): 0.005 wt % or less (excluding 0 wt %), aluminum (Al): 0.050 wt % or less (excluding 0 wt %), chromium (Cr): 2.5 wt % or less (including 0 wt %), boron (B): 0.0005 to 0.01 wt %, nitrogen (N): 0.03 wt % or less (excluding 0 wt %), and a balance of iron (Fe) and other inevitable impurities, wherein stacked defect energy (SFE) represented by the following relationship 1 is 3.05 mJ/m$^2$ or more, and a microstructure includes 95 area % or more (including 100 area %) of austenite, and includes 6 area % or more of deformed grain boundaries in a recrystallized austenite grain.

$$SFE(mJ/m^2)=-24.2+0.950*Mn+39.0*C-2.53*Si-5.50*Al-0.765*Cr \quad \text{[Relationship 1]}$$

where Mn, C, Cr, Si, and Al denote weight percent of respective components.

According to an aspect of the present disclosure, a method of manufacturing a high-strength austenite-based high-manganese steel material, includes: preparing a slab, wherein the slab includes manganese (Mn) 20 to 23 wt %, carbon (C): 0.3 to 0.5 wt %, silicon (Si): 0.05 to 0.50 wt %, phosphorus (P): 0.03 wt % or less (excluding 0 wt %), sulfur (S): 0.005 wt % or less (excluding 0 wt %), aluminum (Al): 0.050 wt % or less (excluding 0 wt %), chromium (Cr): 2.5 wt % or less (including 0 wt %), boron (B): 0.0005 to 0.01 wt %, nitrogen (N): 0.03 wt % or less (excluding 0 wt %), and a balance of iron (Fe) and other inevitable impurities, wherein stacked defect energy (SFE) represented by the following relationship 1 is 3.05 mJ/m$^2$ or more; reheating the slab at a temperature of 1050 to 1300° C.; hot-rolling the reheated slab to obtain a hot-rolled steel material; and cooling the hot-rolled steel material, wherein, during or after the cooling, the hot-rolled steel material is soft rolled at a low reduction ratio of 0.1 to 10% at a temperature of 25 to 180° C., and is soft rolled at a low reduction ratio of 0.1 to 20% at a temperature of 180 to 600° C.:

$$SFE(mJ/m^2)=-24.2+0.950*Mn+39.0*C-2.53*Si-5.50*Al-0.765*Cr \quad \text{[Relationship 1]}$$

where Mn, C, Cr, Si, and Al denote weight percent of respective components.

Before the weak rolling, an average grain size of austenite of the hot-rolled steel material may be 5 μm or more.

Advantageous Effects

According to an aspect of the present disclosure, an austenite-based high-manganese steel material having a uniform austenite phase and having excellent strength and ductility by increasing a fraction of grain boundaries in a grain, and a method for manufacturing the same, may be provided.

DESCRIPTION OF DRAWINGS

FIG. 1 is a graph illustrating a change in overall grain boundary density depending on a low rolling reduction.

FIG. 2 is a graph illustrating a change in a fraction of deformed grain boundaries in a recrystallized austenite grain after weak rolling.

FIG. 3 is an image illustrating that deformed grain boundaries are formed in a recrystallized austenite grain after weak rolling in Inventive Example 2, and illustrates a misorientation profile of the grain boundaries.

BEST MODE FOR INVENTION

Hereinafter, preferred embodiments of the present disclosure will be described.

However, embodiments of the present disclosure may be provided to more fully describe the present disclosure to those skilled in the art.

In addition, embodiments of the present disclosure may be modified in various other forms, and the scope of the present disclosure is not limited to embodiments described below.

In addition, 'including' or 'comprising' certain components throughout the specification refers that other components are not excluded, but may be further included, unless otherwise specified.

Hereinafter, a high-strength austenite-based high-manganese steel material according to a preferred aspect of the present disclosure will be described in detail.

A high-strength austenite-based high-manganese steel material according to one preferred aspect of the present disclosure may include: manganese (Mn): 20 to 23 wt %, carbon (C): 0.3 to 0.5 wt %, silicon (Si): 0.05 to 0.50 wt %, phosphorus (P): 0.03 wt % or less (excluding 0 wt %), sulfur (S): 0.005 wt % or less (excluding 0 wt %), aluminum (Al): 0.050 wt % or less (excluding 0 wt %), chromium (Cr): 2.5 wt % or less (including 0 wt %), boron (B): 0.0005 to 0.01 wt %, nitrogen (N): 0.03 wt % or less (excluding 0 wt %), and a balance of iron (Fe) and other inevitable impurities, wherein stacked defect energy (SFE) represented by the following relationship 1 is 3.05 $mJ/m^2$ or more, and a microstructure includes 95 area % or more (including 100 area %) of austenite, and includes 6 area % or more of deformed grain boundaries in a recrystallized austenite grain.

$$SFE(mJ/m^2)=-24.2+0.50*Mn+39.0*C-2.53*Si-5.50*Al-0.765*Cr \quad \text{[Relationship 1]}$$

where Mn, C, Cr, Si, and Al denote weight percent of respective components.

First, components and ranges of components of the steel material will be described.

Manganese (Mn): 20 to 23 wt %

The content of the manganese may be limited to 20 to 23 wt %. The manganese may be an element that serves to stabilize austenite. The manganese may be included 20 wt % or more to stabilize an austenite phase at cryogenic temperatures. When the content of the manganese is less than 20 wt %, in a case of a steel material having a relatively small carbon content, a metastable ε-martensite may be formed to be easily transformed to α'-martensite by strain induced transformation at cryogenic temperatures, to lower toughness of a steel material. In addition, in the case of a steel material having a relatively large carbon content in order to secure toughness of a steel material, properties of the steel material may rapidly decrease due to carbide precipitation. When the content of the manganese exceeds 23 wt %, economics of the steel material may be reduced due to an increase in manufacturing costs.

Carbon (C): 0.3 to 0.5 wt %

The content of carbon may be limited to 0.3 to 0.5 wt %. The carbon may be an element that stabilizes austenite and increases strength of a steel material. The carbon may serve to lower Ms and Md, transformation points of austenite, ε-martensite, or α'-martensite, by a cooling process or processing. When the content of the carbon is less than 0.3 wt %, stability of austenite may be insufficient to obtain a stable austenite at cryogenic temperatures, and may easily undergo strain induced transformation to ε-martensite or α'-martensite by external stress, to reduce toughness and strength of the steel material. When the content of the carbon exceeds 0.5 wt %, toughness of the steel material may be rapidly deteriorated due to carbide precipitation, and strength of the steel material may be excessively high, to reduce workability of the steel material. Therefore, the content of the carbon of the present disclosure may be limited to 0.3 to 0.5%, and is more preferably limited to 0.3 to 0.43%.

Silicon (Si): 0.05 to 0.5 wt %

Si may be an element that may be inevitably added in trace amounts as a deoxidizer, such as Al. When Si is excessively added, oxides may be formed at grain boundaries to reduce ductility at high temperatures, and cause cracks and the like, to deteriorate surface quality. Since excessive costs may be required to reduce an amount of Si added in the steel, a lower limit of Si may be limited to 0.05 wt %. Since the oxidation property may be higher than that of Al, when it is added in an amount exceeding 0.5 wt %, oxides may be formed to cause cracks and the like, to deteriorate surface quality. Therefore, the Si content may be limited to have a range of 0.05 to 0.5 wt %.

Chromium (Cr): 2.5 wt % or Less (Including 0 wt %)

Chromium may stabilize austenite, when it is added up to a range of an appropriate amount, to improve impact toughness at low temperatures, and may be dissolved in austenite to increase strength of a steel material. Chromium may be also an element that improves corrosion resistance of the steel material. Chromium may be an element of a carbide, and may be particularly an element that forms the carbide at grain boundaries of the austenite to reduce impact properties at low temperatures. Therefore, the content of chromium may be determined in consideration of a relationship with carbon and other elements to be added, and, considering an expensive element, the Cr content may be limited to 2.5 wt % or less (including 0 wt %), is more preferably limited to 0 to 2 wt %, and is even more preferably limited to 0.001 to 2 wt %.

Boron (B): 0.0005 to 0.01 wt %

The content of boron may be limited to 0.0005 to 0.01 wt %. The boron may be a grain boundary strengthening element for strengthening grain boundaries of austenite. Even when only a relatively small amount of boron is added, the grain boundaries of austenite may be strengthened to lower crack sensitivity of a steel material at high temperatures. When the boron content is less than 0.0005 wt %, an effect for strengthening the grain boundaries of austenite may be lowered, and may not significantly contribute to improvement of surface quality. When the boron content exceeds 0.01 wt %, grain boundary segregation may occur at the grain boundaries of austenite, which may increase crack sensitivity of the steel material at high temperatures, to deteriorate surface quality of the steel material. More preferred boron content is 0.0005 to 0.006 wt %, even more preferred boron content is 0.001 to 0.006 wt %

Aluminum (Al): 0.050 wt % or Less (Excluding 0 wt %)

The content of aluminum may be limited to 0.050 wt % or less (excluding 0 wt %). The aluminum may be added as a deoxidizer. The aluminum may react with C or N to produce a precipitate. Since workability in hot-rolling may be deteriorated by the precipitate, the aluminum content may be limited to 0.050 wt % or less (excluding 0 wt %). A more preferred aluminum content is 0.005 to 0.05 wt %.

S: 0.005 wt % or Less (Excluding 0 wt %)

Sulfur (S) needs to be controlled to 0.005 wt % or less to control inclusions. When the S content exceeds 0.005 wt %, hot brittleness may occur.

P: 0.03 wt % or Less (Excluding 0 wt %)

Phosphorous (P) may be an element in which segregation is easily generated, and may promote cracking during casting. In order to prevent this, P should be controlled to 0.03 wt % or less. When the P content exceeds 0.03 wt %, castability may deteriorate. Therefore, an upper limit thereof may be set to be 0.03 wt %.

N: 0.03 wt % or Less (Excluding 0 wt %)

Nitrogen (N) may be bond to Ti to form a Ti nitride. When the N content exceeds 0.03 wt %, free N that does not bind to Ti may cause aging hardening to significantly inhibit toughness of a base material, and may also cause cracks on surfaces of a slab and a steel plate to exhibit harmful properties such as deterioration of surface quality. Therefore, an upper limit thereof may be set to be 0.03 wt %.

The steel material of the present disclosure may include residual iron (Fe) and other inevitable impurities. Unintended impurities may be inevitably incorporated from a raw material or a surrounding environment in the course of a conventional steel manufacturing process, and, thus, may not be excluded. Since these impurities may be known to a person skilled in the ordinary steel manufacturing process, all of these may be not specifically mentioned in the present disclosure.

In a high-strength austenite-based high-manganese steel material according to one preferred aspect of the present disclosure, wherein stacked defect energy (SFE) represented by the following relationship 1 may be 3.05 mJ/m$^2$ or more.

$$SFE(mJ/m^2)=-24.2+0.950*Mn+39.0*C-2.53*Si-5.50*Al-0.765*Cr \quad \text{[Relationship 1]}$$

where Mn, C, Cr, Si, and Al denote weight percent of respective components.

When the stacked defect energy (SFE) is less than 3.05 mJ/m$^2$, ε-martensite and α'-martensite may occur. In particular, when α'-martensite occurs, permeability may increase rapidly. As the stacked defect energy (SFE) increases, stability of austenite may increase. Therefore, an upper limit thereof may be not limited. When SFE exceeds 17.02 mJ/m$^2$, efficiency of components may be not high. Therefore, the upper limit thereof is preferably limited to 17.02 mJ/m$^2$.

A high-strength austenite-based high-manganese steel material according to one preferred aspect of the present disclosure may include 95 area % or more (including 100 area %) of austenite, and may include 6% or more of deformed grain boundaries in a recrystallized austenite grain.

As a paramagnetic material, austenite having a low permeability and excellent non-magnetic properties, compared to ferrite, may be an essential microstructure for securing non-magnetic properties.

When an area fraction of the austenite is less than 95 area %, it may be difficult to secure non-magnetic properties.

When an area fraction of the deformed grain boundaries in the recrystallized austenite grain of the steel material is less than 6 area %, a strengthening effect may be insufficient. When an area fraction of the deformed grain boundaries in the recrystallized austenite grain of the steel material is 6 area % or more, the strength may increase rapidly. The area fraction of the deformed grain boundaries may be 6 to 95 area %.

In this case, the deformed grain boundaries refer to grain boundaries formed by strain imparted when weak rolling is performed.

The microstructure may include one or two of inclusions and ε-martensite in an area fraction of 5 area % or less (including 0 area %).

When the area fraction of one or two of inclusions and ε-martensite exceeds 5 area %, precipitates in grain boundaries of austenite may cause grain boundary facture, and toughness and ductility of the steel material may decrease.

The inclusions may be included in grain boundaries of austenite.

The inclusions may be carbides.

Hereinafter, a method of manufacturing a high-strength austenite-based high-manganese steel according to another preferred aspect of the present disclosure will be described.

A method of manufacturing a high-strength austenite-based high-manganese steel material according to another preferred aspect of the present disclosure may include: preparing a slab, wherein the slab includes manganese (Mn): 20 to 23 wt %, carbon (C): 0.3 to 0.5 wt %, silicon (Si): 0.05 to 0.50 wt %, phosphorus (P): 0.03 wt % or less (excluding 0 wt %), sulfur (S): 0.005 wt % or less (excluding 0 wt %), aluminum (Al): 0.050 wt % or less (excluding 0 wt %), chromium (Cr): 2.5 wt % or less (including 0 wt %), boron (B): 0.0005 to 0.01 wt %, nitrogen (N): 0.03 wt % or less (excluding 0 wt %), and a balance of iron (Fe) and other inevitable impurities, wherein stacked defect energy (SFE) represented by the following relationship 1 is 3.05 mJ/m$^2$ or more; reheating the slab at a temperature of 1050 to 1300° C.; hot-rolling the reheated slab to obtain a hot-rolled steel material; and cooling the hot-rolled steel material, wherein, during or after the cooling, the hot-rolled steel material is soft rolled at a low reduction ratio of 0.1 to 10% at a temperature of 25 to 180° C., and is soft rolled at a low reduction ratio of 0.1 to 20% at a temperature of 180 to 600° C.:

$$SFE(mJ/m^2)=-24.2+0.950*Mn+39.0*C-2.53*Si-5.50*Al-0.765*Cr \quad \text{[Relationship 1]}$$

where Mn, C, Cr, Si, and Al denote weight percent of respective components.

Reheating Slab

A slab having the above-mentioned steel composition may be reheated at a temperature of 1050 to 1300° C. in a heating furnace for hot-rolling. In this case, when a reheating temperature is too low, e.g., less than 1050° C., there may be a problem that a load may be greatly applied during rolling, and an alloy component may be not sufficiently dissolved. When a reheating temperature is too high, there may be a problem that the grains may grow excessively and strength may decrease, and the reheating may exceed solidus temperatures of a steel material to damage hot-rolling properties of the steel material. Therefore, an upper limit of the reheating temperature may be limited to 1300° C.

Hot-Rolling

The reheated slab may be hot-rolled to obtain a hot-rolled steel material. The hot-rolling may include a rough rolling process and a finish rolling process. In this case, a hot finish rolling temperature may be limited to 800 to 1050° C. When the hot finish rolling temperature is less than 800° C., a rolling load may be greatly applied. When the hot finish rolling temperature exceeds 1050° C., grains may grow coarsely and target strength may not be obtained. Therefore, an upper limit thereof may be limited to 1050° C.

Cooling

The hot-rolled steel material obtained in the hot-rolling may be cooled.

Cooling of the hot-rolled steel material, after hot finish rolling, may be performed at a cooling rate sufficient to suppress formation of a grain boundary carbide. The cooling rate may be 1 to 100° C./s. When the cooling rate is less than 1° C./s, it may not be sufficient to avoid carbide formation, and carbides may precipitate at grain boundaries during cooling, which decreases ductility due to premature fracture of the steel material, and thus deteriorates wear resistance. Therefore, it is advantageous that the cooling rate is fast, and, when it is within a range of accelerated cooling, there may be no need to specifically limit an upper limit of the cooling rate. In a case of conventional accelerated cooling, considering that the cooling rate may be difficult to exceed 100° C./s, the upper limit thereof may be limited to 100° C./s.

In cooling the hot-rolled steel material, a cooling stop temperature may be limited to 600° C. or less. Even in a case of cooling at a rapid rate, carbides may occur and grown when cooling is stopped at a high temperature.

Weak Rolling

During or after the cooling, the hot-rolled steel material may be soft rolled at a low reduction ratio of 0.1 to 10% at a temperature of 25 to 180° C., and may be soft rolled at a low reduction ratio of 0.1 to 20% at a temperature of 180 to 600° C.

An average grain size of austenite of the hot-rolled steel material, before the weak rolling, may be 5 μm or more. Since strength of the steel material may be lowered when the grain size is greatly increased, a grain size of austenite may be 5 to 150 μm.

When a weak rolling temperature is less than 25° C., there is a possibility of phase transformation into ε-martensite or α'-martensite. When a weak rolling temperature exceeds 600° C., there may be a problem that efficiency for improving strength may be lowered.

When the low reduction ratio is less than 0.1%, there may be a problem of low improvement for strength. When the low reduction ratio exceeds 10% at a temperature of 25 to 180° C. or exceeds 20% at a temperature of 180 to 600° C., there may be a problem of a reduction in elongation.

According to a method of manufacturing a high-strength austenite-based high-manganese steel material according to another preferred aspect of the present disclosure, a high-strength austenite-based high-manganese steel material having a microstructure comprises 95 area % or more (including 100 area %) of austenite, and comprises 6 area % or more of deformed grain boundaries in a recrystallized austenite grain may be produced.

MODE FOR INVENTION

Hereinafter, the present disclosure will be described in more detail by Examples. However, it is necessary to note that embodiments described below are only intended to exemplify the present disclosure and are not intended to limit the scope of the present disclosure. This is because the scope of the present disclosure may be determined by matters described in the claims and reasonably inferred therefrom.

Example

After reheating slabs satisfying the components, the component ranges, and the stacked defect energy (SFE), illustrated in Table 1 below, at a temperature of 1200° C., the reheated slabs were hot-rolled under the conditions of the hot finish rolling temperature illustrated in Table 2 below to obtain hot-rolled steel materials having the thicknesses of Table 2 below, and the hot-rolled steel materials were cooled to a temperature of 300° C. at a cooling rate of 20° C./s.

After the cooling, the hot-rolled steel materials were soft rolled under the conditions illustrated in Table 3 below.

Overall crystal grain boundary density (grain boundary density), deformed grain boundary newly formed by strain in grain (grain boundary fraction in grain), yield strength (YS), tensile strength (TS), elongation (El), and permeability of the hot-rolled steel plate (steel material) prepared as above were measured, and the results therefrom were illustrated in Table 3 below.

In Table 1 below, SFE represents stacked defect energy, and may be a value obtained by the following relationship 1:

$$SFE(mJ/m^2)=-24.2+0.950*Mn+39.0*C-2.53*Si-5.50*Al-0.765*Cr \quad \text{[Relationship 1]}$$

where Mn, C, Cr, Si, and Al denote weight percent of respective components.

Changes in overall grain boundary density for Inventive Examples and Comparative Examples, depending on low rolling reduction, were illustrated in FIG. 1, and changes in deformed grain boundary fraction in recrystallized austenite grains, after weak rolling, were illustrated in FIG. 2.

In addition, an image illustrating that deformed grain boundaries were formed in recrystallized austenite grains of Inventive Example 2, after weak rolling, and a misorientation profile of the grain boundaries were illustrated in FIG. 3.

TABLE 1

| | C | Si | Mn | Cr | P | S | Al | B | N | SFE ($mJ/m^2$) |
|---|---|---|---|---|---|---|---|---|---|---|
| IE1 | 0.40 | 0.156 | 21.51 | 1.99 | 0.0178 | 0.0022 | 0.035 | 0.0024 | 0.0113 | 9.72 |
| IE2 | 0.40 | 0.156 | 21.51 | 1.99 | 0.0178 | 0.0022 | 0.035 | 0.0024 | 0.0113 | 9.72 |
| IE3 | 0.40 | 0.156 | 21.51 | 1.99 | 0.0178 | 0.0022 | 0.035 | 0.0024 | 0.0113 | 9.72 |
| IE4 | 0.40 | 0.156 | 21.51 | 1.99 | 0.0178 | 0.0022 | 0.035 | 0.0024 | 0.0113 | 9.72 |
| IE5 | 0.40 | 0.156 | 21.51 | 1.99 | 0.0178 | 0.0022 | 0.035 | 0.0024 | 0.0113 | 9.72 |
| IE6 | 0.40 | 0.156 | 21.51 | 1.99 | 0.0178 | 0.0022 | 0.035 | 0.0024 | 0.0113 | 9.72 |
| IE7 | 0.40 | 0.156 | 21.51 | 1.99 | 0.0178 | 0.0022 | 0.035 | 0.0024 | 0.0113 | 9.72 |
| IE8 | 0.40 | 0.156 | 21.51 | 1.99 | 0.0178 | 0.0022 | 0.035 | 0.0024 | 0.0113 | 9.72 |
| IE9 | 0.40 | 0.156 | 21.51 | 1.99 | 0.0178 | 0.0022 | 0.035 | 0.0024 | 0.0113 | 9.72 |
| IE10 | 0.40 | 0.156 | 21.51 | 1.99 | 0.0178 | 0.0022 | 0.035 | 0.0024 | 0.0113 | 9.72 |
| IE11 | 0.40 | 0.156 | 21.51 | 1.99 | 0.0178 | 0.0022 | 0.035 | 0.0024 | 0.0113 | 9.72 |
| IE12 | 0.40 | 0.156 | 21.51 | 1.99 | 0.0178 | 0.0022 | 0.035 | 0.0024 | 0.0113 | 9.72 |
| CE1 | 0.40 | 0.156 | 21.51 | 1.99 | 0.0178 | 0.0022 | 0.035 | 0.0024 | 0.0113 | 9.72 |
| CE2 | 0.39 | 0.206 | 22.30 | 2.20 | 0.0198 | 0.0011 | 0.022 | 0.0028 | 0.0127 | 9.87 |
| CE3 | 0.39 | 0.206 | 22.30 | 2.20 | 0.0198 | 0.0011 | 0.022 | 0.0028 | 0.0127 | 9.87 |
| CE4 | 0.40 | 0.156 | 21.51 | 1.99 | 0.0178 | 0.0022 | 0.035 | 0.0024 | 0.0113 | 9.72 |
| IE13 | 0.40 | 0.156 | 21.51 | 1.99 | 0.0178 | 0.0022 | 0.035 | 0.0024 | 0.0113 | 9.72 |
| IE14 | 0.40 | 0.156 | 21.51 | 1.99 | 0.0178 | 0.0022 | 0.035 | 0.0024 | 0.0113 | 9.72 |

IE: Inventive Example,
CE: Comparative Example

TABLE 2

| | Furnace Temp. (° C.) | Extraction Temp. (° C.) | Finish Rolling Temp. (° C.) | Final Thickness (mm) |
|---|---|---|---|---|
| IE1 | 1195 | 1201 | 921 | 9 |
| IE2 | 1195 | 1201 | 921 | 9 |
| IE3 | 1195 | 1201 | 921 | 9 |
| IE4 | 1195 | 1201 | 921 | 9 |
| IE5 | 1195 | 1201 | 921 | 9 |
| IE6 | 1195 | 1201 | 921 | 9 |
| IE7 | 1195 | 1201 | 921 | 9 |
| IE8 | 1195 | 1201 | 921 | 9 |
| IE9 | 1195 | 1201 | 921 | 9 |
| IE10 | 1195 | 1201 | 921 | 9 |

TABLE 2-continued

| | Furnace Temp. (° C.) | Extraction Temp. (° C.) | Finish Rolling Temp. (° C.) | Final Thickness (mm) |
|---|---|---|---|---|
| IE11 | 1195 | 1201 | 921 | 9 |
| IE12 | 1195 | 1201 | 921 | 9 |
| CE1 | 1195 | 1201 | 921 | 9 |
| CE2 | 1170 | 1120 | 899 | 20 |
| CE3 | 1150 | 1110 | 888 | 20 |
| CE4 | 1195 | 1201 | 921 | 9 |
| IE13 | 1195 | 1201 | 921 | 9 |
| IE14 | 1195 | 1201 | 921 | 9 |

IE: Inventive Example, CE: Comparative Example

TABLE 3

| | Weak Rolling Conditions | | | Crystal Grain Boundaries Formation | | Tensile Properties | | | |
|---|---|---|---|---|---|---|---|---|---|
| | Plate Temp. (° C.) | Final Thickness (mm) | Reduction Ratio (%) | Overall Grain Boundary Density (1/μm) | Grain Boundary Fraction in grain (%) | YS (Mpa) | TS (Mpa) | El (%) | Permeability |
| IE1 | 25 | 8.91 | 1 | 0.18 | 45.7 | 478 | 954 | 51 | 1.003 |
| IE2 | 25 | 8.73 | 3 | 0.34 | 69.1 | 596 | 994 | 45 | 1.003 |
| IE3 | 25 | 8.55 | 5 | 0.3 | 66.1 | 670 | 1032 | 43 | 1.003 |
| IE4 | 25 | 8.1 | 10 | 0.36 | 67.8 | 837 | 1148 | 22 | 1.004 |
| IE5 | 180 | 8.91 | 1 | 0.14 | 26.7 | 448 | 952 | 52 | 1.003 |
| IE6 | 180 | 8.73 | 3 | 0.18 | 40.8 | 507 | 965 | 51 | 1.003 |
| IE7 | 180 | 8.55 | 5 | 0.19 | 43.0 | 577 | 989 | 46 | 1.005 |
| IE8 | 180 | 8.1 | 10 | 0.28 | 67.3 | 718 | 1045 | 38 | 1.005 |
| IE9 | 600 | 8.91 | 1 | 0.15 | 25.9 | 429 | 950 | 55 | 1.004 |
| IE10 | 600 | 8.73 | 3 | 0.18 | 32.0 | 480 | 974 | 52 | 1.005 |
| IE11 | 600 | 8.55 | 5 | 0.2 | 42.9 | 503 | 982 | 51 | 1.005 |
| IE12 | 600 | 8.1 | 10 | 0.19 | 42.1 | 596 | 1004 | 45 | 1.004 |
| CE1 | — | 9 | 0 | 0.12 | 3.1 | 417 | 917 | 53 | 1.003 |
| CE2 | — | 20 | 0 | 0.19 | 5.2 | 410 | 889 | 49 | 1.004 |

TABLE 3-continued

| | Weak Rolling Conditions | | | Crystal Grain Boundaries Formation | | Tensile Properties | | | |
|---|---|---|---|---|---|---|---|---|---|
| | Plate Temp. (° C.) | Final Thickness (mm) | Reduction Ratio (%) | Overall Grain Boundary Density (1/μm) | Grain Boundary Fraction in grain (%) | YS (Mpa) | TS (Mpa) | El (%) | Permeability |
| CE3 | — | 20 | 0 | 0.22 | 5.6 | 435 | 918 | 53 | 1.004 |
| CE4 | 25 | 7.2 | 20 | — | — | 1089 | 1429 | 12 | 1.008 |
| IE13 | 180 | 7.2 | 20 | 0.33 | 70.1 | 918 | 1187 | 26 | 1.005 |
| IE14 | 600 | 7.2 | 20 | 0.22 | 55.4 | 759 | 1095 | 36 | 1.004 |

IE: Inventive Example,
CE: Comparative Example

As illustrated in Tables 1 to 3 and FIGS. 1 and 2, it can be seen that, Inventive Examples 1 to 14, which were hot-rolled steel material manufactured by using slabs satisfying the components, the component ranges, and the stacked defect energy (SFE), according to the present disclosure, and the manufacturing conditions (hot-rolling, cooling, and weak rolling conditions) according to the present disclosure, has a grain boundary fraction in grain according to the present disclosure, as well as excellent yield strength (YS), tensile strength (TS), and elongation (El), compared to Comparative Examples 1 to 4, outside of the weak rolling conditions of the present disclosure.

As illustrated in FIG. 3, it can be seen that, when the weak rolling conditions of the present disclosure was applied (Inventive Example 2), a large amount of deformed grains was formed in the recrystallized austenite grains.

While example embodiments have been illustrated and described above, it will be apparent to those skilled in the art that modifications and variations could be made without departing from the scope of the present disclosure as defined by the appended claims.

The invention claimed is:

1. An austenite-based high-manganese steel material, comprising: manganese (Mn): 20 to 23 wt %, carbon (C): 0.3 to 0.5 wt %, silicon (Si): 0.05 to 0.50 wt %, phosphorus (P): 0.03 wt % or less (excluding 0 wt %), sulfur (S): 0.005 wt % or less (excluding 0 wt %), aluminum (Al): 0.050 wt % or less (excluding 0 wt %), chromium (Cr): 2.5 wt % or less (including 0 wt %), boron (B): 0.0005 to 0.01 wt %, nitrogen (N): 0.03 wt % or less (excluding 0 wt %), and a balance of iron (Fe) and other inevitable impurities, wherein stacked defect energy (SFE) represented by the following relationship 1 is 3.05 to 17.02 $mJ/m^2$, a microstructure comprises 95 area % or more (including 100 area %) of austenite, and comprises 6 to 95 area % of deformed grain boundaries in a recrystallized austenite grain, and wherein the steel material comprises 429 MPa or more of yield strength, 950 MPa or more of tensile strength and 22% or more of elongation, $$SFE(mJ/m^2)=-24.2+0.950*Mn+39.0*C-2.53*Si-5.50*Al-0.765*Cr \quad \text{[Relationship 1]}$$

where Mn, C, Cr, Si, and Al denote weight percent of respective components.

2. The austenite-based high-manganese steel material according to claim 1, wherein the microstructure comprises 5 area % or less of an inclusion and/or 5 area % or less of ε-martensite.

3. The austenite-based high-manganese steel material according to claim 2, wherein the inclusion is carbide.

4. The austenite-based high-manganese steel material according to claim 2, wherein the inclusion is included in grain boundaries of the austenite.

* * * * *